US010221871B2

(12) United States Patent
Imura et al.

(10) Patent No.: US 10,221,871 B2
(45) Date of Patent: Mar. 5, 2019

(54) CONSTRUCTION MACHINERY

(71) Applicants: Hitachi Construction Machinery Co., Ltd., Bunkyo-ku, Tokyo (JP); Takako Satake, Ishioka-shi (JP)

(72) Inventors: Shinya Imura, Tokyo (JP); Hidetoshi Satake, Ishioka (JP); Kouji Ishikawa, Kasumigaura (JP); Seiji Hijikata, Tsukuba (JP); Takatoshi Ooki, Kasumigaura (JP); Shinji Nishikawa, Kasumigaura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 107 days.

(21) Appl. No.: 15/422,152

(22) Filed: Feb. 1, 2017

(65) Prior Publication Data

US 2017/0175782 A1 Jun. 22, 2017

Related U.S. Application Data

(63) Continuation of application No. 14/233,159, filed as application No. PCT/JP2012/064323 on Jun. 1, 2012, now abandoned.

(30) Foreign Application Priority Data

Jul. 25, 2011 (JP) ..... 2011-162499

(51) Int. Cl.
*F15B 13/06* (2006.01)
*F15B 21/00* (2006.01)
(Continued)

(52) U.S. Cl.
CPC ..... *F15B 13/06* (2013.01); *E02F 9/123* (2013.01); *E02F 9/2095* (2013.01);
(Continued)

(58) Field of Classification Search
CPC ..... E02F 9/123; E02F 9/2095; E02F 9/2217; E02F 9/2235; E02F 9/2242; E02F 9/2282;
(Continued)

(56) References Cited

U.S. PATENT DOCUMENTS 6,390,947 B1 5/2002 Aoki et al.
6,460,332 B1 10/2002 Maruta et al.
(Continued)

FOREIGN PATENT DOCUMENTS

JP 59-16563 5/1984
JP 2004-84907 A 3/2004
(Continued)

OTHER PUBLICATIONS

International Preliminary Report of Appln. No. PCT/JP2012/064323 dated Feb. 6, 2014.
(Continued)

*Primary Examiner* — Nathaniel E Wiehe
*Assistant Examiner* — Richard C Drake
(74) *Attorney, Agent, or Firm* — Crowell & Moring LLP

(57) ABSTRACT

The Construction machinery includes at least two actuators, a main pump that generates hydraulic energy for driving the actuators, control valves disposed between the main pump and the actuators, a hydraulic pump motor driven by the generator motor that generates energy to be added to the hydraulic energy, and a controller that reduces hydraulic energy generated by the main pump when the hydraulic pump motor driven by the generator-motor generates energy. The construction machinery further comprises changeover valves that selectively change a location at which the energy from the hydraulic pump motor driven by the generator-motor is to be added according to the actuators. The controller changes a reduction rate of the hydraulic energy
(Continued)

generated by the main pump depending on a specific actuator to which the energy is to be added.

1 Claim, 5 Drawing Sheets

(51) Int. Cl.

| | |
|---|---|
| ***E02F 9/12*** | (2006.01) |
| ***E02F 9/22*** | (2006.01) |
| ***F15B 21/14*** | (2006.01) |
| ***F15B 11/20*** | (2006.01) |
| ***E02F 9/20*** | (2006.01) |

(52) U.S. Cl.
CPC ..... *E02F 9/2217* (2013.01); *E02F 9/2235* (2013.01); *E02F 9/2242* (2013.01); *E02F 9/2282* (2013.01); *E02F 9/2292* (2013.01); *E02F 9/2296* (2013.01); *F15B 11/20* (2013.01); *F15B 21/001* (2013.01); *F15B 21/14* (2013.01); *F15B 2211/20546* (2013.01); *F15B 2211/20569* (2013.01); *F15B 2211/20576* (2013.01); *F15B 2211/7053* (2013.01); *F15B 2211/7058* (2013.01); *F15B 2211/88* (2013.01)

(58) Field of Classification Search
CPC ..... E02F 9/2292; E02F 9/2296; F15B 11/20; F15B 21/001; F15B 21/14; F15B 13/06
USPC ..... 60/420
See application file for complete search history.

(56) References Cited

U.S. PATENT DOCUMENTS

| | | | | |
|---|---|---|---|---|
| 6,502,393 | B1 | 1/2003 | Stephenson et al. | |
| 7,565,801 | B2 | 7/2009 | Tozawa et al. | |
| 7,908,852 | B2 | 3/2011 | Zhang et al. | |
| 8,453,441 | B2 | 6/2013 | Williamson et al. | |
| 8,517,890 | B2 | 8/2013 | Hayashi et al. | |
| 8,812,202 | B2 | 8/2014 | Yamamoto et al. | |
| 9,037,356 | B2 | 5/2015 | Kawasaki et al. | |
| 10,017,918 | B2 * | 7/2018 | Tsukada | E02F 9/22 |
| 2003/0221339 | A1 * | 12/2003 | Naruse | E02F 9/2217 37/348 |
| 2005/0246082 | A1 | 11/2005 | Miki et al. | |
| 2010/0170239 | A1 | 7/2010 | Sora | |
| 2015/0247305 | A1 * | 9/2015 | Imura | E02F 9/2095 60/413 |
| 2016/0215481 | A1 * | 7/2016 | Kawasaki | F15B 21/14 |
| 2017/0009428 | A1 * | 1/2017 | Hijikata | F15B 21/14 |

FOREIGN PATENT DOCUMENTS

| | | | |
|---|---|---|---|
| JP | 2006-336549 | A | 12/2006 |
| JP | 2010-14243 | A | 1/2010 |

OTHER PUBLICATIONS

Cundiff, John S. ("Creation and Control of Fluid Flow", 2001, electronic presentation. <retrieved on Apr. 14, 2016> <URL: http://abe.ufl.edu/tburks/Presentations/ABE5152/Ch.%204.pdf>.

* cited by examiner

CONSTRUCTION MACHINERY

This application is a continuation of U.S. application Ser. No. 14/233,159, filed Jan. 16, 2014, which is a 371 of International Application No. PCT/JP2012/064323, filed Jun. 1, 2012, which claims priority from Japanese Patent Application No. 2011-162499, filed Jul. 25, 2011, the disclosures of which are expressly incorporated by reference herein.

TECHNICAL FIELD

The present invention relates generally to construction machinery and, more particularly, to construction machinery that includes two or more energy supply devices for a single actuator.

BACKGROUND ART

A hydraulic excavator as one type of construction machinery generally includes a prime mover such as an engine, a hydraulic pump driven by the prime mover, hydraulic actuators including hydraulic cylinders for driving, for example, a boom, an arm, a bucket, and a swing structure using hydraulic oil delivered from the hydraulic pump, and a control valve (operating valve) that supplies the hydraulic oil from the hydraulic pump selectively to the hydraulic actuator. In such construction machinery, in order to reduce driving power of a driving power source and fuel consumption of the entire construction machinery, a known technique recovers potential energy of the boom that falls by its own weight and inertia kinetic energy of the swing structure to achieve effective use of these types of energy.

One known arrangement, for example, includes a recovery device that recovers return oil from a hydraulic actuator. In the arrangement, after the recovery of the return oil, a regenerative device regenerates a flow rate and, when the regenerative flow rate is to be merged with a discharge flow rate from a hydraulic pump, the discharge flow rate from the hydraulic pump driven by a driving device, such as an engine, is varied according to the regenerative flow rate (see, for example, patent document 1).

PRIOR ART DOCUMENT

Patent Document

Patent Document 1: JP-2004-84907-A

SUMMARY OF THE INVENTION

Problem to be Solved by the Invention

In the related art disclosed in patent document 1, the total flow rate of the hydraulic oil after the merge of the regenerative flow rate and the discharge flow rate from the hydraulic pump is supplied to the hydraulic actuator via a control valve (operating valve).

Energy loss occurs in the control valve due to leakage of the hydraulic oil or pressure loss and it is difficult to use the whole of the recovered energy in the hydraulic actuator. Thus, the above-mentioned related art poses a problem in that a fuel reduction effect cannot be sufficiently achieved.

The present invention has been made in view of the foregoing situation and it is an object of the present invention to provide construction machinery that can achieve a great fuel reduction effect through an efficient use of recovered energy.

Means for Solving the Problem

To achieve the foregoing object, a first aspect of the present invention provides construction machinery including at least two actuators, a main pump that generates hydraulic energy for driving the actuators, flow control means disposed between the main pump and the actuators, additional energy generating means that generates energy to be added to the hydraulic energy, and control means that reduces hydraulic energy generated by the main pump when the additional energy generating means generates energy, the construction machinery including: changeover means that selectively changes a location at which the energy from the additional energy generating means is to be added according to the actuators, wherein the control means changes a reduction rate of the hydraulic energy generated by the main pump depending on a specific actuator to which the energy is to be added.

According to a second aspect of the present invention, in the first aspect of the present invention, the changeover means changes the location at which the energy from the additional energy generating means is to be added between a side of the main pump relative to the flow control means and a side of the actuators relative to the flow control means depending on the specific actuator to which the energy is to be added.

According to a third aspect of the present invention, in the first or second aspect of the present invention, the additional energy generating means includes energy storage means, a prime mover that operates on energy stored in the energy storage means, and a hydraulic pump driven by the prime mover.

According to a fourth aspect of the present invention, in the first aspect of the present invention, the changeover means changes the location at which the energy is to be added between the side of the main pump relative to the flow control means and a side on which the energy directly acts on the actuator depending on the specific actuator to which the energy is to be added.

According to a fifth aspect of the present invention, in the first or fourth aspect of the present invention, the additional energy generating means includes the energy storage means and prime movers that operate on energy stored in the energy storage means, and at least one of the actuators is a combined actuator connected to at least one of the prime movers.

According to a sixth aspect of the present invention, in the fifth aspect of the present invention, the additional energy generating means allows a rate of change at which energy generated by the prime mover that constitutes the combined actuator is increased or decreased to be controlled in response to a response lag in an output of the main pump.

According to a seventh aspect of the present invention, in the first aspect of the present invention, the control means controls the main pump so as to increase the reduction rate of the energy generated by the main pump with smaller losses occurring before the energy generated by the additional energy generating means drives the actuators.

According to an eighth aspect of the present invention, in the seventh aspect of the present invention, the control means controls the main pump so as to increase the reduction rate of the energy generated by the main pump when the location at which the energy is to be added is on the side of the actuators relative to the flow control means than when the location at which the energy is to be added is on the side of the main pump relative to the flow control means.

Effects of the Invention

The present invention can provide construction machinery that can considerably reduce fuel consumption of the entire construction machinery by reducing driving power of the driving power source through an efficient use of recovered energy.

MODES FOR CARRYING OUT THE INVENTION

Embodiments of the present invention will be described below for an exemplary hydraulic excavator as the construction machinery with reference to the accompanying drawings. The present invention is applicable to general construction machinery (including work implements) including swing structures and the hydraulic excavator does not represent the only possible type of construction machinery to which the present invention can be applied.

First Embodiment

Figure 1:
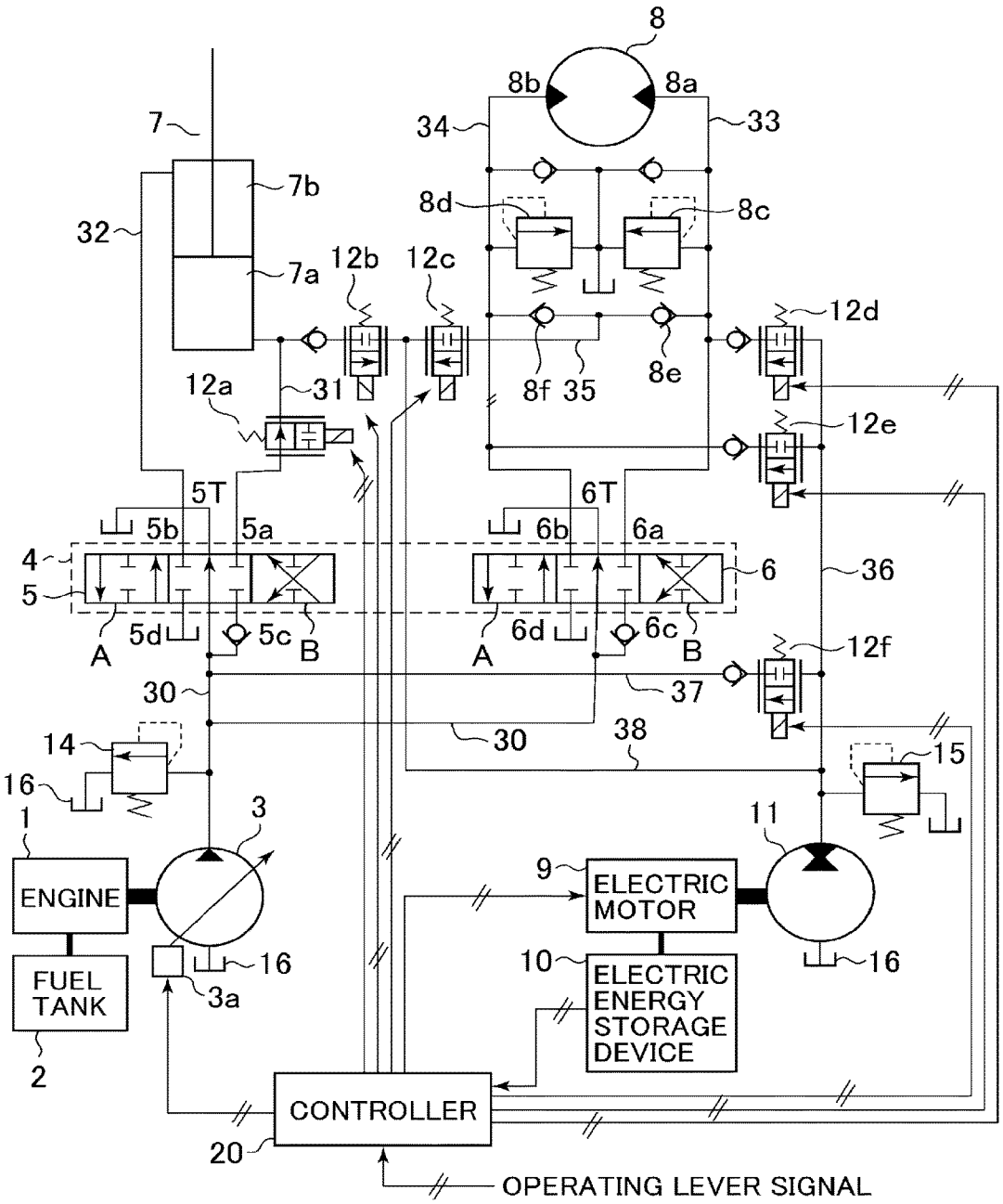
FIG. 1 is a system configuration diagram showing electric and hydraulic devices that constitute construction machinery according to a first embodiment of the present invention.

FIG. 1 is a system configuration diagram showing electric and hydraulic devices that constitute the construction machinery according to a first embodiment of the present invention. In FIG. 1, reference numeral 1 denotes an engine as a driving power source, reference numeral 2 denotes a fuel tank that stores therein fuel supplied to the engine 1, reference numeral 3 denotes a variable displacement main pump driven by the engine 1, reference numeral 4 denotes control valves as flow control means, reference numeral 5 denotes a boom-operating control valve, reference numeral 6 denotes a swing structure-operating control valve, reference numeral 7 denotes a boom cylinder, reference numeral 8 denotes a swing hydraulic motor, reference numeral 9 denotes a generator-motor (prime mover), reference numeral 10 denotes an electric energy storage device (energy storage means) including a capacitor or a battery, reference numeral 11 denotes a hydraulic pump motor (additional energy generating means) driven by the generator-motor 9, reference numerals 12*a* to 12*f* denote changeover valves, and reference numeral 20 denotes a controller (control means). The main pump 3 includes, for example, a swash plate as a variable displacement mechanism. A tilting angle of the swash plate is varied by a displacement control device 3*a* to thereby change a displacement (displacement volume) of the main pump 3 for controlling a discharge flow rate of hydraulic oil.

A relief valve 14 and the control valves 4 are disposed in a main line 30 that supplies the hydraulic oil discharged from the main pump 3 to actuators including the boom cylinder 7 and the swing hydraulic motor 8. The relief valve 14 limits pressure of the hydraulic oil in the main line 30; specifically, when the pressure in the hydraulic line rises to a set pressure or higher, the relief valve 14 causes the hydraulic oil in the main line 30 to escape to a hydraulic oil tank 16. The control valves 4 control the direction and the flow rate of the hydraulic oil.

The control valves 4 as the flow control means includes the boom-operating control valve 5 and the swing structure-operating control valve 6. The boom-operating control valve 5 and the swing structure-operating control valve 6 are each a three-position, six-port changeover control valve having a pilot operating portion (not shown) to which pilot pressure is supplied. The pilot pressure changes the position of each control valve, thereby varying an opening area of a flow path of the hydraulic oil. The direction and the flow rate of the hydraulic oil supplied from the main pump 3 to each of the actuators 7 and 8 are thus controlled for driving the actuators 7 and 8. In addition, the boom-operating control valve 5 and the swing structure-operating control valve 6 have inlet ports 5*c* and 6*c* to which the hydraulic oil is supplied from the main pump 3, outlet ports 5*d* and 6*d* that communicate with the hydraulic oil tank 16, center ports 5T and 6T that provide communication in their neutral positions, and connection ports 5*a*, 5*b*, 6*a*, and 6*b* that are connected to the actuators 7 and 8, respectively.

The boom cylinder 7 includes a cylinder and a piston rod. The cylinder includes an oil chamber 7*a* on a bottom side and an oil chamber 7*b* on a rod side. A first line 31, in which the changeover valve 12*a* to be described later is disposed, has a first end side connected to the oil chamber 7*a* on the bottom side and a second end side connected to the connection port 5*a* of the boom-operating control valve 5. A second line 32 has a first end side connected to the oil chamber 7*b* on the rod side and a second end side connected to the connection port 5*b* of the boom-operating control valve 5.

The swing hydraulic motor 8 has two hydraulic oil inlets 8*a* and 8*b*. The direction of rotation of the swing hydraulic motor 8 can be changed by selecting the appropriate hydraulic oil inlet to which the hydraulic oil is supplied. A third line 33 has a first end side connected to the hydraulic oil inlet 8*a* and a second end side connected to the connection port 6*a* of the swing structure-operating control valve 6. A fourth line 34 has a first end side connected to the hydraulic oil inlet 8*b* and a second end side connected to the connection port 6*b* of the swing structure-operating control valve 6.

The third line 33 and the fourth line 34 include overload relief valves 8*c* and 8*d*, respectively. In addition, the third line 33 and the fourth line 34 include check valves 8*e* and 8*f*, respectively, that allow flow from the respective lines only. The check valves 8*e* and 8*f* have outlet sides connected to a fifth line 35.

The generator-motor 9, upon receiving a command from the controller 20 to be described later, performs either powering control in which electric power from the electric energy storage device 10 is used to generate torque or regenerative control in which electric power generated by absorbing torque is stored in the electric energy storage device 10 as the energy storage means.

The hydraulic pump motor 11 has its rotational shaft connected directly or mechanically via, for example, a gear to a rotational shaft of the generator-motor 9. When the generator-motor 9 is operated under the powering control, the hydraulic pump motor 11 operates as a hydraulic pump, pumping up the hydraulic oil from the hydraulic oil tank 16 and discharging the hydraulic oil to a first sub-line 36 and a second sub-line 37 to be described later. With the generator-motor 9 operated under the regenerative control, the hydraulic pump motor 11 operates as a hydraulic motor rotated by pressure of the hydraulic oil from a third sub-line 38 to be described later.

The hydraulic pump motor 11 assumes an additional energy generating means when operated as the hydraulic pump, generating additional energy for driving the boom cylinder 7 and the swing hydraulic motor 8. This additional energy can be obtained by integrating a product of preset displacement of the hydraulic pump motor 11, and a detected rotating speed and discharge pressure of the hydraulic pump motor 11 with time.

The first sub-line 36 through which the hydraulic oil from the hydraulic pump motor 11 is discharged when the hydraulic pump motor 11 is operated as the hydraulic pump includes a relief valve 15 that limits pressure of the hydraulic oil in the first sub-line 36 and the changeover valves 12*d* to 12*f* that provide or interrupt communication with the hydraulic oil. The second sub-line 37 has a first end side connected to the first sub-line 36 via the changeover valve 12*f* and a second end side connected to the main line 30. The third sub-line 38 has a first end side branch-connected to the first sub-line 36 and a second end side connected to the first line 31 and the fifth line 35, respectively, via the changeover valves 12*b* and 12*c*, respectively. The relief valve 15 causes the hydraulic oil in the first sub-line 36 to escape to the hydraulic oil tank 16 when the pressure in the hydraulic line rises to a set pressure or higher. It is noted that the changeover valves 12*b* to 12*f* are each a two-port, two-position solenoid changeover valve. The position of each of the changeover valves 12*b* to 12*f* is controlled by a command from the controller 20 to be described later.

The changeover valve 12*b* has a first port connected to an outlet side of a check valve that allows flow from the first line 31 only and a second port connected to the third sub-line 38.

The changeover valve 12*c* has a first port connected to a branch portion of the fifth line 35 and a second port connected to the third sub-line 38.

The changeover valve 12*d* has a first port connected to an inlet side of a check valve that allows flow into the third line 33 only and a second port connected to the first sub-line 36.

The changeover valve 12*e* has a first port connected to an inlet side of a check valve that allows flow into the fourth line 34 only and a second port connected to the first sub-line 36.

The changeover valve 12*f* has a first port connected to an inlet side of a check valve that allows flow into the main line 30 via the second sub-line 37 only and a second port connected to the first sub-line 36.

The changeover valves 12*d*, 12*e*, and 12*f* are each changeover means as one of features of the present invention. By controlling to open or close each of these valves, a location to which energy is added is selected. Specifically, the location to which the energy is added can be selected from among the hydraulic oil inlet 8*a* and the hydraulic oil inlet 8*b* of the swing hydraulic motor 8 and the main line 30 that assumes a discharge line of the main pump 3.

The controller 20 receives inputs of an operation signal of each operating lever not shown and an electric power storage amount of the electric energy storage device 10. The controller 20 then outputs a discharge flow rate command to the displacement control device 3*a* to thereby control displacement of the main pump 3 and outputs a powering or regenerative command to the generator-motor 9 to thereby control torque of the hydraulic pump motor 11. Additionally, the controller 20 outputs a current command to a solenoid operating portion of each of the changeover valves 12*a* to 12*f* to thereby control an open or closed position of the changeover valve.

Operations of the construction machinery according to the first embodiment of the present invention will be described below. A boom operation performed by an operator will be first described.

In FIG. 1, the boom-operating control valve 5 is shown in a neutral position at which the operating amount of the operating lever not shown is zero. In this case, the connection ports 5*a* and 5*b* are shut off from the inlet port 5*c* and the outlet port 5*d*, respectively, and the center port 5T provides communication, so that the hydraulic oil from the main pump 3 is supplied to the hydraulic oil tank 16.

When a boom raising operation is performed using the operating lever not shown, the pilot pressure supplied to the pilot operating portion (not shown) causes the boom-operating control valve 5 to move to the right to be placed in position A. This provides communication between the inlet port 5*c* and the connection port 5*a* and between the outlet port 5*d* and the connection port 5*b*. In addition, the controller 20 receives an input of a boom raising operation signal and outputs an open command to a solenoid operating portion of the changeover valve 12*a* and a close command to a solenoid operating portion of the changeover valve 12*b*. This results in the hydraulic oil from the main pump 3 being supplied through the first line 31 to the oil chamber 7*a* on the bottom side of the boom cylinder 7 and the hydraulic oil in the oil chamber 7*b* on the rod side of the boom cylinder 7 being discharged through the second line 32 to the hydraulic oil tank 16. As a result, the piston rod of the boom cylinder 7 is extended.

When a boom lowering operation is performed, the pilot pressure supplied to the pilot operating portion (not shown) causes the boom-operating control valve 5 to move to the left to be placed in position B. This provides communication between the inlet port 5*c* and the connection port 5*b* and between the outlet port 5*d* and the connection port 5*a*. In addition, the controller 20 receives an input of a boom lowering operation signal and outputs a close command to the solenoid operating portion of the changeover valve 12*a* and an open command to the solenoid operating portion of the changeover valve 12*b*. This results in the hydraulic oil from the main pump 3 being supplied through the second line 32 to the oil chamber 7*b* on the rod side of the boom cylinder 7, so that the piston rod of the boom cylinder 7 is contracted, and the hydraulic oil in the oil chamber 7*a* on the bottom side of the boom cylinder 7 being guided through the first line 31 and the third sub-line 38 to the hydraulic pump motor 11. This results in the hydraulic pump motor 11 operating as a hydraulic motor, thus rotating the generator-motor 9. At this time, the controller 20 performs regenerative control so as to generate torque in a direction opposite to the rotating direction of the generator-motor 9 and stores the generated electric power in the electric energy storage device 10.

When the boom raising operation using the operating lever not shown is performed with sufficient electric power stored in the electric energy storage device 10 as the energy storage means, the following additional energy sequence control is performed by the controller 20. Operations of the boom-operating control valve 5 and the like are the same as those during the boom raising operation described above.

The electric power storage amount of the electric energy storage device 10 input to the controller 20 is first compared with a preset value. If the boom raising operation signal is input with the input value exceeding the preset value, the controller 20 outputs an open command to the solenoid operating portion of the changeover valve 12*f*, in addition to the command signals to the solenoid operating portions of the changeover valves 12*a* and 12*b* described above. In addition, the controller 20 outputs a powering command to the generator-motor 9, thereby causing the hydraulic pump motor 11 to operate as a hydraulic pump, so that the hydraulic oil discharged from the hydraulic pump motor 11 is merged into the main line 30 via the first sub-line 36, the changeover valve 12*f*, and the second sub-line 37. This adds additional energy for the boom raising operation.

Meanwhile, the controller 20 outputs a discharge flow rate reduction command to the displacement control device 3*a* to thereby control to reduce displacement of the main pump 3, thus achieving reduction for the discharge flow rate added from the hydraulic pump motor 11. The amount of hydraulic oil supplied to the boom cylinder 7 thereby remains unchanged and no change in operability occurs as affected by availability or unavailability of additional energy. To reduce the discharge flow rate of the main pump 3 results in hydraulic energy generated in the main pump 3 being reduced. As a result, load on the engine 1 as the driving source is reduced, so that fuel consumption of the engine 1 can be reduced.

A swing operation performed by the operator will be described below.

In FIG. 1, the swing structure-operating control valve 6 is shown in a neutral position at which the operating amount of the operating lever not shown is zero. When a clockwise swing operation is performed using the operating lever not shown, the pilot pressure supplied to the pilot operating portion (not shown) causes the swing structure-operating control valve 6 to move to the right to be placed in position A. This provides communication between the inlet port 6*c* and the connection port 6*a* and between the outlet port 6*d* and the connection port 6*b*. In addition, the controller 20 receives an input of a clockwise swing operation signal and outputs a close command to a solenoid operating portion of the changeover valve 12*c*. This results in the hydraulic oil from the main pump 3 being supplied through the third line 33 to the hydraulic oil inlet 8*a* of the swing hydraulic motor 8 and the hydraulic oil from the hydraulic oil inlet 8*b* of the swing hydraulic motor 8 being discharged through the fourth line 34 to the hydraulic oil tank 16. As a result, the swing hydraulic motor 8 is operated so as to achieve the clockwise swing operation.

Meanwhile, when the above-described clockwise swing operation is performed and the operating lever not shown is thereafter placed in the neutral position, specifically, during swing deceleration, the swing structure-operating control valve 6 is placed in the condition shown in FIG. 1 and the connection ports 6*a* and 6*b* are shut off from the inlet port 6*c* and the outlet port 6*d*, respectively, with the center port 6T providing communication. The controller 20 receives an input of a swing neutral operation signal and outputs an open command to the solenoid operating portion of the changeover valve 12*c*. This results in the hydraulic oil discharged from the hydraulic oil inlets 8*a* and 8*b* of the swing hydraulic motor 8 being guided through the fifth line 35 and the third sub-line 38 to the hydraulic pump motor 11. This causes the hydraulic pump motor 11 to operate as a hydraulic motor to rotate the generator-motor 9. At this time, the controller 20 performs regenerative control so as to generate torque in a direction opposite to the rotating direction of the generator-motor 9 and stores the generated electric power in the electric energy storage device 10.

When the clockwise swing operation using the operating lever not shown is performed with sufficient electric power stored in the electric energy storage device 10 as the energy storage means, the following additional energy sequence control is performed by the controller 20. Operations of the swing structure-operating control valve 6 and the like are the same as those during the clockwise swing operation described above.

The electric power storage amount of the electric energy storage device 10 input to the controller 20 is first compared with the preset value. If the clockwise swing operation signal is input with the input value exceeding the preset value, the controller 20 outputs a close command to the solenoid operating portion of the changeover valve 12*c*, an open command to the solenoid operating portion of the changeover valve 12*d*, and a close command to the solenoid operating portion of the changeover valve 12*e*, respectively. In addition, the controller 20 outputs a powering command to the generator-motor 9, thereby causing the hydraulic pump motor 11 to operate as a hydraulic pump, so that the hydraulic oil discharged from the hydraulic pump motor 11 is merged into the third line 33 via the first sub-line 36 and the changeover valve 12*d*. This adds additional energy for the clockwise swing operation.

Meanwhile, the controller 20 outputs a discharge flow rate reduction command to the displacement control device 3*a* to thereby control to reduce the displacement of the main pump 3, thus achieving reduction for the discharge flow rate added from the hydraulic pump motor 11. In this swing operation, the hydraulic oil is merged (the energy is added) at a position in the third line 33 between the swing structure-operating control valve 6 and the swing hydraulic motor 8. Unlike the boom raising operation described earlier, therefore, the hydraulic oil discharged from the hydraulic pump motor 11 does not pass through the swing structure-operating control valve 6. This eliminates energy loss arising from hydraulic oil leakage or pressure loss that can occur during the passage of the control valve. The controller 20 reduces the discharge flow rate of the main pump 3 more than the discharge flow rate of the hydraulic pump motor 11.

Specifically, the controller 20 makes a reduction rate of the hydraulic energy generated by the main pump 3 during the clockwise swing operation greater than a reduction rate during the boom raising operation. The reduction rate K of the hydraulic energy generated by the main pump 3 is defined by the following expression: K={(energy generated by the main pump 3 without additional energy)−(energy generated by the main pump 3 with additional energy)÷(energy generated by the hydraulic pump motor 11).

Thus, the amount of hydraulic oil supplied to the swing hydraulic motor 8 is not varied between a case with the additional energy and a case without the additional energy to thereby prevent a change in operability from occurring. Additionally, the energy generated by the main pump 3 is reduced more than the energy generated by the hydraulic pump motor 11. As a result, load on the engine 1 as the driving source is reduced, so that fuel consumption of the engine 1 can be reduced.

When a counterclockwise swing operation is performed, the pilot pressure supplied to the pilot operating portion (not shown) causes the swing structure-operating control valve 6 to move to the left to be placed in position B. This provides communication between the inlet port 6*c* and the connection port 6*b* and between the outlet port 6*d* and the connection port 6*a*. In addition, the controller 20 receives an input of a counterclockwise swing operation signal and outputs a close command to the solenoid operating portion of the changeover valve 12*c*. This results in the hydraulic oil from the main pump 3 being supplied through the fourth line 34 to the hydraulic oil inlet 8*b* of the swing hydraulic motor 8 and the hydraulic oil from the hydraulic oil inlet 8*a* of the swing hydraulic motor 8 being discharged through the third line 33 to the hydraulic oil tank 16. As a result, the swing hydraulic motor 8 is operated so as to achieve the counterclockwise swing operation.

When sufficient electric power is stored in the electric energy storage device 10, the controller 20 controls to open the changeover valve 12*e* and close the changeover valve 12*d*. Other control methods and control effects are the same as those in the clockwise swing operation and descriptions therefor will be omitted.

Figure 2:
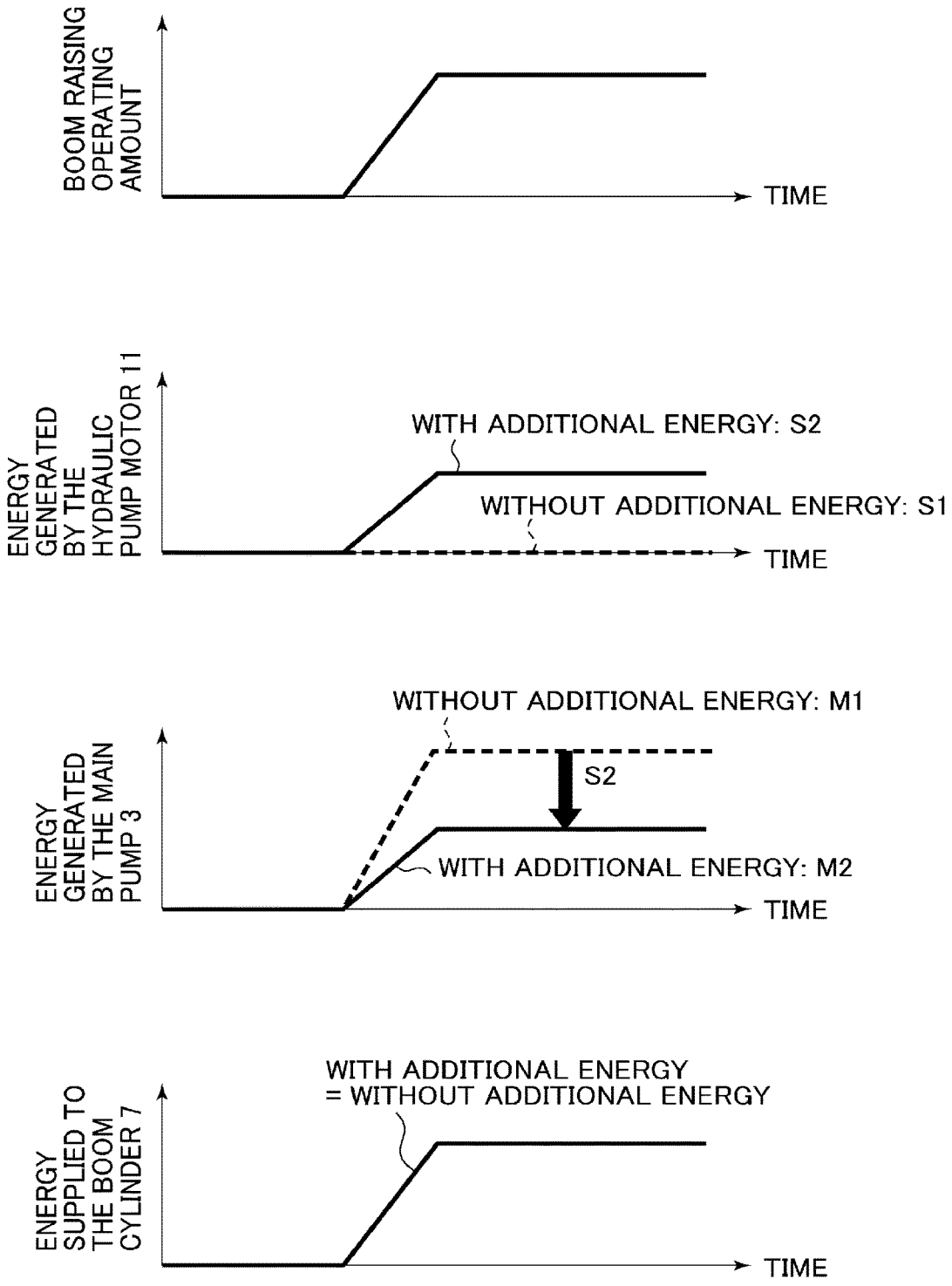
FIG. 2 is a characteristic diagram showing an exemplary relation among energy generated by a hydraulic pump motor, energy generated by a main pump, and energy supplied to a boom cylinder during a boom raising operation in the construction machinery according to the first embodiment of the present invention.
Figure 3:
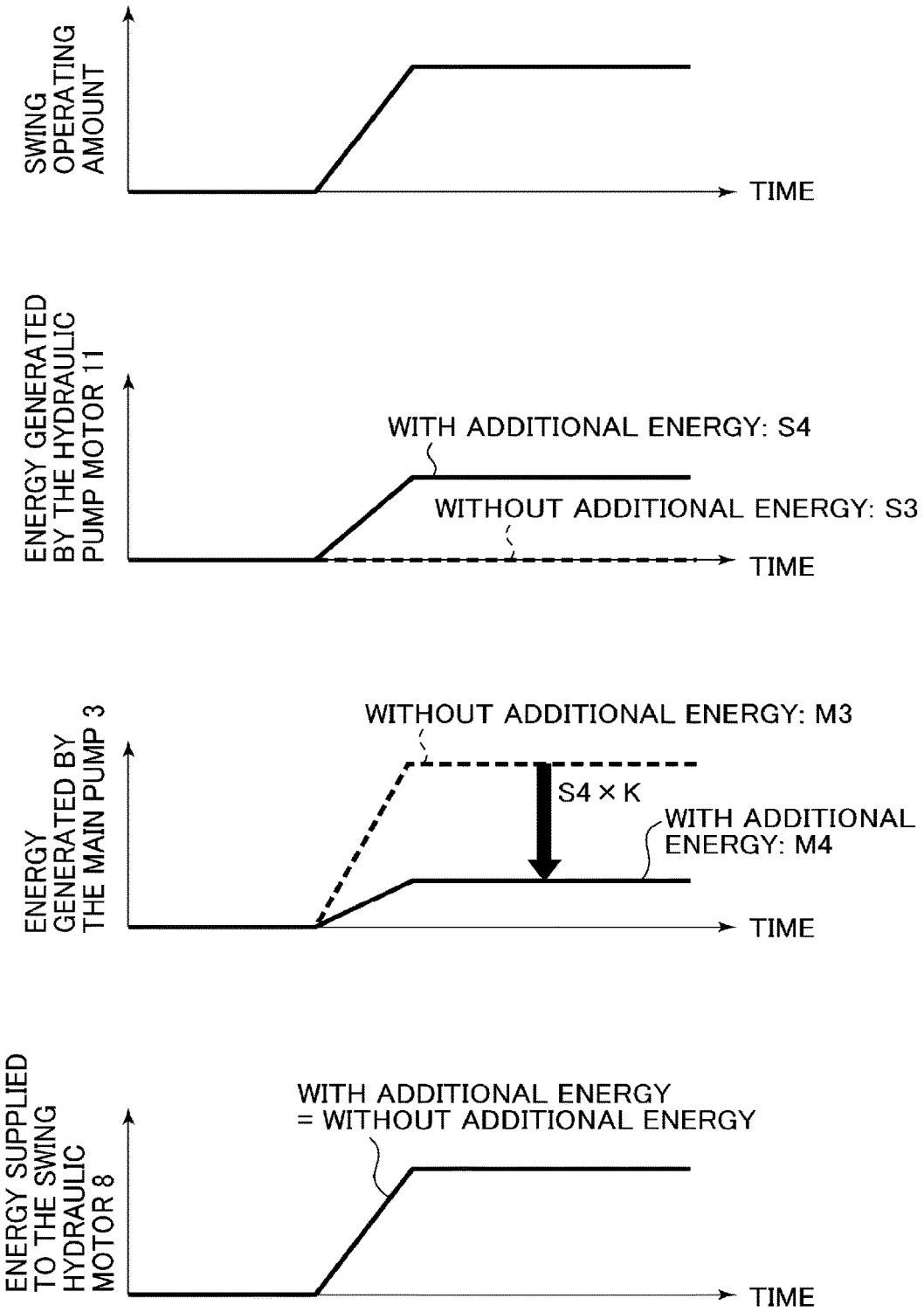
FIG. 3 is a characteristic diagram showing an exemplary relation among energy generated by the hydraulic pump motor, energy generated by the main pump, and energy supplied to a swing hydraulic motor during a swing operation in the construction machinery according to the first embodiment of the present invention.

Relations between, for example, energy generated by the hydraulic pump motor and energy generated by the main pump in the construction machinery according to the first embodiment of the present invention will be described below with reference to FIGS. 2 and 3. FIG. 2 is a characteristic diagram showing an exemplary relation among the energy generated by the hydraulic pump motor, the energy generated by the main pump, and energy supplied to the boom cylinder during the boom raising operation in the construction machinery according to the first embodiment of the present invention. FIG. 3 is a characteristic diagram showing an exemplary relation among the energy generated by the hydraulic pump motor, the energy generated by the main pump, and energy supplied to the swing hydraulic motor during the swing operation in the construction machinery according to the first embodiment of the present invention.

In FIGS. 2 and 3, a portion indicated by the broken line shows characteristics "without additional energy" representing a case in which sufficient electric power is not stored in the electric energy storage device 10 and the hydraulic pump motor 11 does not generate additional energy. A portion indicated by the solid line shows characteristics "with additional energy" representing a case in which sufficient electric power is stored in the electric energy storage device 10 and the hydraulic pump motor 11 generates additional energy.

In the case "with additional energy" in the boom raising operation shown in FIG. 2, hydraulic energy S2 is generated (hydraulic oil is discharged) by the hydraulic pump motor 11 according as the boom raising operation progresses. At the same time, hydraulic energy M2 generated by the main pump 3 is kept smaller than energy M1 of the case "without additional energy." At this time, the controller 20 performs control so that the following expression holds:

$$M2=M1-S2$$

Performance of such control as that described above makes energy supplied to the boom cylinder 7 in the case "with additional energy" and energy supplied to the boom cylinder 7 in the case "without additional energy" equal to each other and the same operability can be maintained regardless of whether or not the additional energy is available. In addition, in the case "with additional energy", energy generated by the main pump 3 is reduced to thereby reduce load on the engine 1 as the driving source, which allows the fuel consumption of the engine 1 to be reduced.

As described earlier, however, in the boom raising operation, the additional energy passes through the control valve 4 to act on the boom cylinder 7 as the actuator. Energy loss then occurs in the control valve 4 and a disadvantage involved here is a fuel reduction effect not sufficiently obtained. The following control is therefore performed in the swing operation.

In the case "with additional energy" in the swing operation shown in FIG. 3, hydraulic energy S4 is generated (hydraulic oil is discharged) by the hydraulic pump motor 11 according as the swing operation progresses. At the same time, hydraulic energy M4 generated by the main pump 3 is kept smaller than energy M3 of the case "without additional energy." At this time, the controller 20 performs control so that the following expression holds:

$$M4=M3-S4\times K$$

Where, K denotes the reduction rate described earlier and a value of 1 or greater is set in advance for K based on energy lost when the hydraulic oil passes through the swing structure-operating control valve 6. Specifically, the value is energy of the hydraulic oil entering the swing structure-operating control valve 6 (a time-integrated value of pressure×flow rate) divided by energy of the hydraulic oil coming out of the swing structure-operating control valve 6 (a time-integrated value of pressure×flow rate).

For example, if the swing structure-operating control valve 6 has an efficiency (=(energy of hydraulic oil coming out)÷(energy of hydraulic oil entering)) of 0.8, the reduction rate K is calculated as 1÷0.8=1.25 and this value of 1.25 is set. This means that the reduction rate K is set to be large if the swing structure-operating control valve 6 has poor efficiency (involving great loss).

Meanwhile, the controller 20 outputs a discharge flow rate reduction command to the displacement control device 3*a* to thereby control to reduce the displacement of the main pump 3, thus achieving reduction for the discharge flow rate added from the hydraulic pump motor 11. In this swing operation, the hydraulic oil is merged (the energy is added) at a position in the third line 33 between the swing structure-operating control valve 6 and the swing hydraulic motor 8. Unlike the boom raising operation described earlier, therefore, the hydraulic oil discharged from the hydraulic pump motor 11 does not pass through the swing structure-operating control valve 6. This eliminates energy loss arising from hydraulic oil leakage or pressure loss that can occur during the passage of the control valve. The controller 20 reduces the discharge flow rate of the main pump 3 more than the discharge flow rate of the hydraulic pump motor 11.

Specifically, the controller 20 makes a reduction rate of the hydraulic energy generated by the main pump 3 during the clockwise swing operation greater than a reduction rate during the boom raising operation. The reduction rate K of the hydraulic energy generated by the main pump 3 is defined by the following expression: K={(energy generated by the main pump 3 without additional energy)−(energy generated by the main pump 3 with additional energy)÷(energy generated by the hydraulic pump motor 11).

To state the foregoing differently, the reduction rate K of the energy generated by the main pump 3 differs between a case in which, as in the boom raising operation, a great loss occurs in the energy generated by the hydraulic pump motor 11 as the additional energy generating means before driving the boom cylinder 7 as an actuator and a case in which, as in the swing operation, a small loss occurs in the energy generated by the hydraulic pump motor 11 as the additional energy generating means before driving the swing hydraulic motor 8 as an actuator. The controller 20 performs control so as to increase the reduction rate K with smaller losses as in the swing operation.

In addition, the reduction rate K of the energy generated by the main pump 3 differs between a case in which, as in the boom raising operation, energy is added at a position on the main pump 3 side of the control valve 4 as the flow control means and a case in which, as in the swing operation, energy is added at a position on the actuator 8 side of the control valve 4 as the flow control means. The controller 20 performs control so as to increase the reduction rate K when energy is added at a position on the actuator 8 side of the control valve 4.

It is noted that the value of the energy of the hydraulic oil entering the swing structure-operating control valve 6 divided by the energy of the hydraulic oil coming out of the swing structure-operating control valve 6 tends to be greater at smaller operating amounts. The reduction rate K may therefore be greater when the operating amount is small.

The foregoing arrangement makes the energy supplied to the swing hydraulic motor 8 in the case "with additional energy" equal to the energy supplied to the swing hydraulic motor 8 in the case "without additional energy" and the same operability can be maintained regardless of whether or not the additional energy is available. In addition, in the case "with additional energy", the energy generated by the main pump 3 is reduced to thereby reduce load on the engine 1 as the driving source, which allows the fuel consumption of the engine 1 to be reduced.

As is known from the above, when the swing operation is performed with sufficient electric power stored in the electric energy storage device 10 as the energy storage means, a greater fuel reduction effect can be obtained than in the boom raising operation.

As described heretofore, the first embodiment of the present invention can provide construction machinery that can considerably reduce fuel consumption of the entire construction machinery by reducing driving power of the engine 1 as the driving power source through an efficient use of recovered energy.

It is noted that, when energy is added in the boom raising operation, the total flow rate of the main pump 3 and the hydraulic pump motor 11 is adjusted by the boom-operating control valve 5 even with an error in flow rate control of the main pump 3 and the hydraulic pump motor 11. This minimizes an error in the flow rate supplied to the boom cylinder 7 and operability is not considerably impaired. When energy is added in the swing operation, however, any error in the flow rate control for the hydraulic pump motor 11 is not adjusted by the swing structure-operating control valve 6 and directly serves as an error in the flow rate supplied to the swing hydraulic motor 8. Nonetheless, because of a large inertia moment of the swing structure, the error does not greatly affect the swing operation and operability is not considerably impaired.

The first embodiment has been described for a case in which the boom cylinder 7 and the swing hydraulic motor 8 are actuators. This is, however, not the only possible arrangement. Alternatively, different actuators may be used in place of the boom cylinder 7 and the swing hydraulic motor 8. Still, the actuator (the swing hydraulic motor 8 in FIG. 1) to which the hydraulic oil discharged from the hydraulic pump motor 11 is directly supplied without flowing through the swing structure-operating control valve 6 needs to be one that is not very much affected by the error in the flow rate control of the hydraulic pump motor 11 or that can afford operability aggravated by the error.

Second Embodiment

Figure 4:
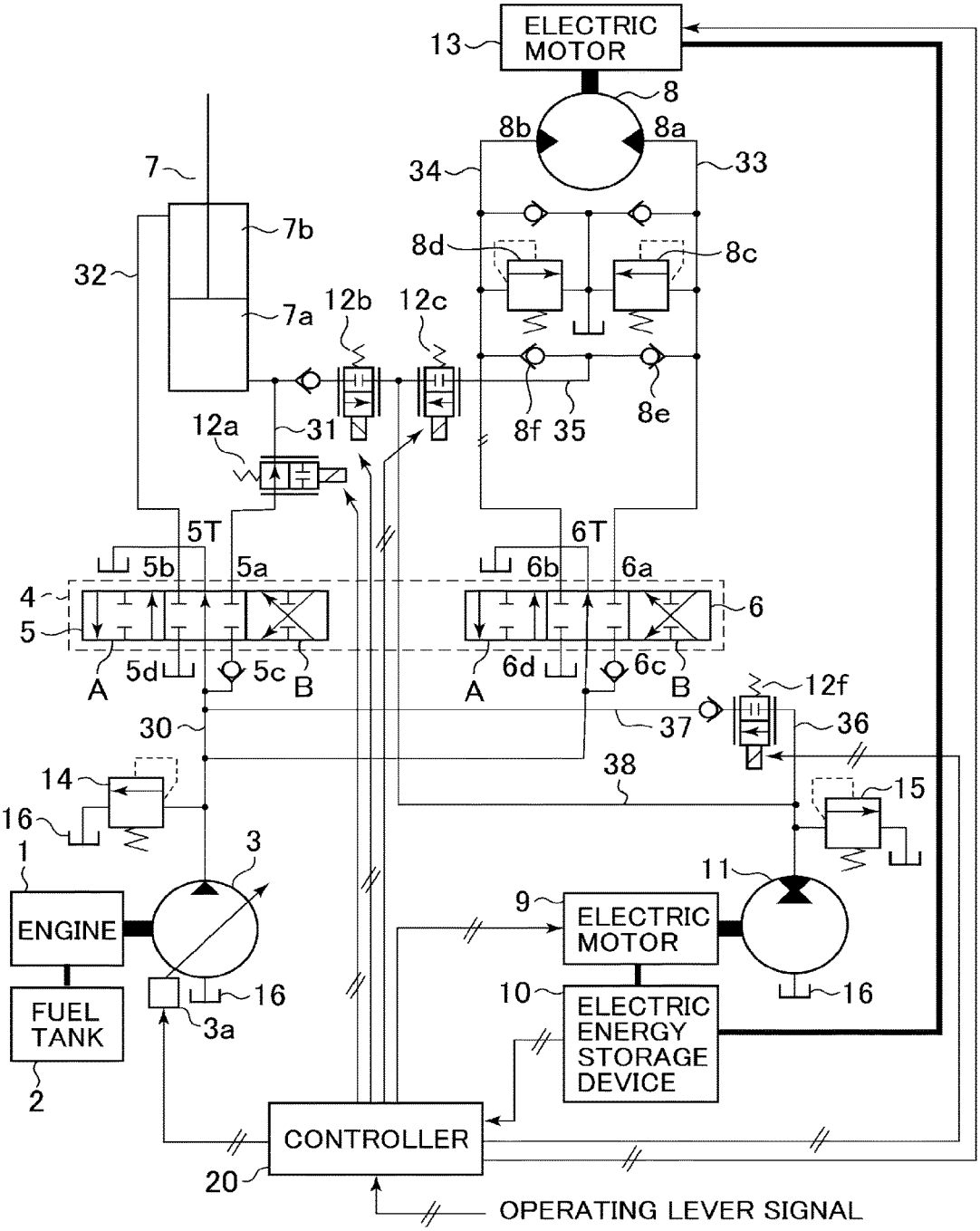
FIG. 4 is a system configuration diagram showing electric and hydraulic devices that constitute construction machinery according to a second embodiment of the present invention.

Construction machinery according to a second embodiment of the present invention will be described below with reference to the accompanying drawings. FIG. 4 is a system configuration diagram showing electric and hydraulic devices that constitute the construction machinery according to the second embodiment of the present invention. In FIG. 4, like or corresponding parts are identified by the same reference numerals as those used in FIGS. 1 to 3 and descriptions for those parts will not be duplicated.

The construction machinery according to the second embodiment of the present invention shown in FIG. 4 comprises a hydraulic source, a work implement, and other elements substantially identical to those of the construction machinery according to the first embodiment. The construction machinery according to the second embodiment of the present invention differs from the construction machinery according to the first embodiment in the following arrangement.

Specifically, the arrangement in which the hydraulic oil discharged from the hydraulic pump motor 11 is merged at a position between the swing structure-operating control valve 6 and the swing hydraulic motor 8 in the first embodiment (the changeover valves 12*d* and 12*e* and the hydraulic line before and after these valves) is omitted. Instead, the construction machinery according to the second embodiment newly includes a rotational shaft of a swing hydraulic motor 8 and a swing electric motor 13 (prime mover) connected directly or mechanically via, for example, a gear to the rotational shaft of the swing hydraulic motor 8 (additional energy generating means).

With a command received from a controller 20, the swing electric motor 13 is operated by powering control in which torque is generated using electric power of an electric energy storage device 10. The swing structure is driven by combined torque of the swing hydraulic motor 8 and the swing electric motor 13. To state the foregoing differently, the swing structure is driven by a combined actuator that couples the swing electric motor 13 to the swing hydraulic motor 8.

Operations of the construction machinery according to the second embodiment of the present invention described above will be described below. The control performed by the controller 20 during boom raising, boom lowering, and swing deceleration is substantially identical to that in the first embodiment described earlier, except for, for example, commands to the omitted changeover valves 12*d* and 12*e*.

When the clockwise or counterclockwise swing operation using an operating lever not shown is performed with sufficient electric power stored in the electric energy storage device 10 as the energy storage means, the following additional energy sequence control is performed by the controller 20. Operations of a swing structure-operating control valve 6 and other elements are the same as those in the first embodiment described earlier.

The electric power storage amount of the electric energy storage device 10 input to the controller 20 is first compared with a preset value. If the clockwise or counterclockwise swing operation signal is input with the input value exceeding the preset value, the controller 20 outputs a close command to a solenoid operating portion of a changeover valve 12*c* and a powering command to the swing electric motor 13, respectively. Thus, the swing electric motor 13 assists the swing hydraulic motor 8 in increasing torque for driving the swing structure. This adds additional energy to perform the clockwise or counterclockwise swing operation. This additional energy can be obtained by integrating a product of a detected torque and rotating speed of the swing electric motor 13 with time.

Meanwhile, the controller 20 outputs a discharge flow rate reduction command to a displacement control device 3*a* so as to achieve reduction in energy for what has been added from the swing electric motor 13 to the swing hydraulic motor 8, thereby controlling to reduce displacement of a main pump 3. In this swing structure operation, the energy generated by the swing electric motor 13 directly acts on the swing structure. As a result, no loss in the energy generated by the hydraulic pump motor 11 for boom raising described earlier occurs at the control valve. Thus, the controller 20 reduces energy generated by the main pump 3 more than energy generated by the swing electric motor 13.

Thus, no change occurs in the energy for driving the swing structure and in operability. Additionally, the energy generated by the main pump 3 is reduced more than the energy generated by the swing electric motor 13. This reduces load on the engine 1 as the driving source, which allows the fuel consumption of the engine 1 to be considerably reduced.

Under a condition in which sufficient electric power is stored in the electric energy storage device 10 as the energy storage means, the controller 20 performs the additional energy sequence control by the swing electric motor 13 during driving the swing structure and the additional energy sequence control that operates the above-described hydraulic pump motor 11 as the hydraulic pump during driving the boom. To drive both the boom and the swing structure simultaneously, the controller 20 performs the additional energy sequence control by the swing electric motor 13 and the additional energy sequence control that operates the hydraulic pump motor 11 as the hydraulic pump.

Figure 5:
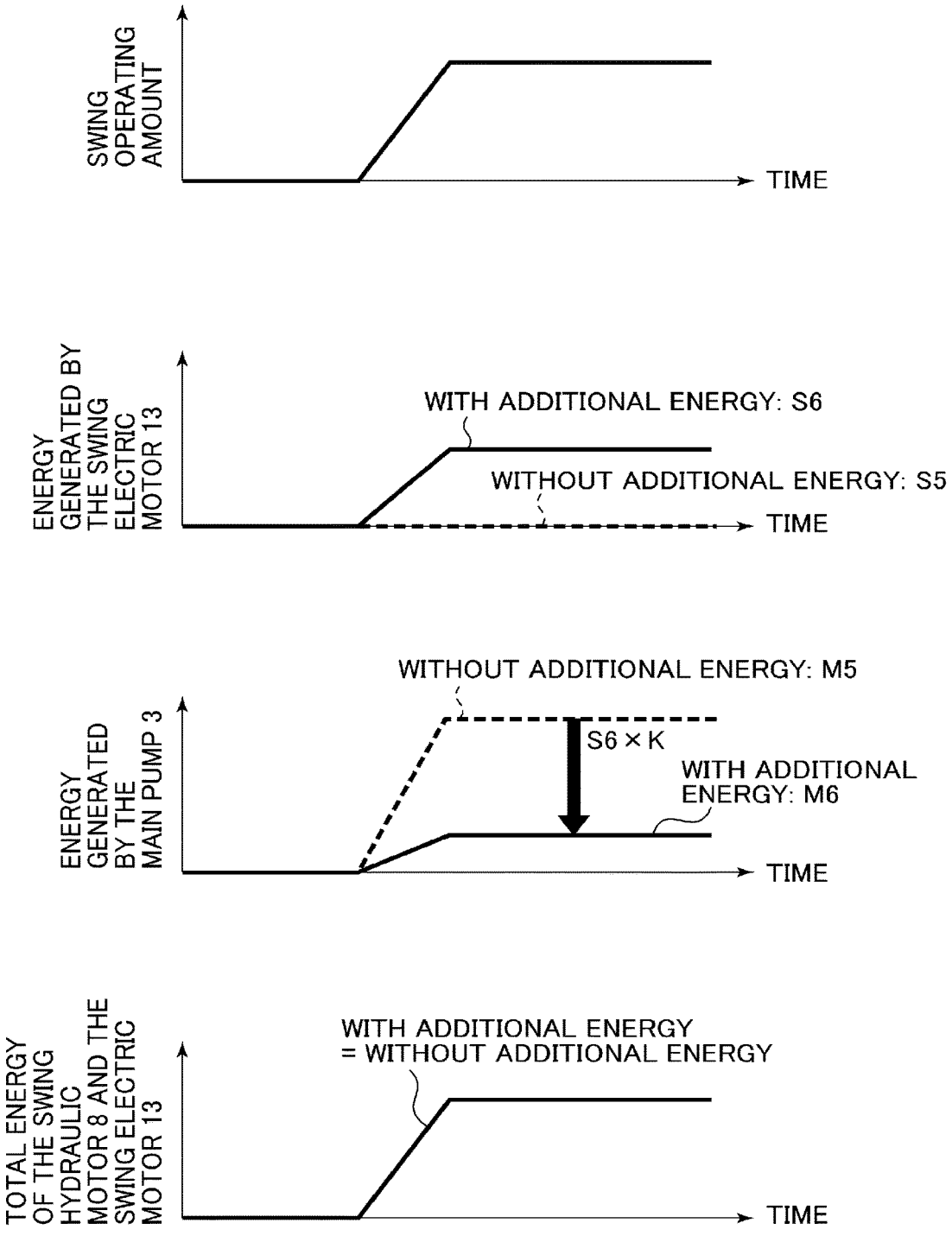
FIG. 5 is a characteristic diagram showing an exemplary relation among energy generated by a swing electric motor, energy generated by a main pump, and total energy of a swing hydraulic motor and the swing electric motor during a swing operation in the construction machinery according to the second embodiment of the present invention.

Relations between energy that drives the swing structure and energy generated by the swing electric motor, energy generated by the main pump, and the like in the construction machinery according to the second embodiment of the present invention described above will be described below with reference to FIG. 5. FIG. 5 is a characteristic diagram showing an exemplary relation among the energy generated by the swing electric motor, the energy generated by the main pump, and total energy of the swing hydraulic motor and the swing electric motor during a swing operation in the construction machinery according to the second embodiment of the present invention. In FIG. 5, like or corresponding parts are identified by the same reference numerals as those used in FIGS. 1 to 4 and descriptions for those parts will not be duplicated.

In FIG. 5, a portion indicated by the broken line shows characteristics "without additional energy" representing a case in which sufficient electric power is not stored in the electric energy storage device 10 and the swing electric motor 13 does not generate additional energy. A portion indicated by the solid line shows characteristics "with additional energy" representing a case in which sufficient electric power is stored in the electric energy storage device 10 and the swing electric motor 13 generates additional energy.

In the case "with additional energy" in the swing operation shown in FIG. 5, energy S6 is generated (torque is generated) using the swing electric motor 13 according as the swing operation progresses. At the same time, hydraulic energy M6 generated by the main pump 3 is kept smaller than energy M5 of the case "without additional energy." At this time, the controller 20 performs control so that the following expression holds:

$$M6=M5-S6\times K$$

Where, K denotes the reduction rate described earlier and a value of 1 or greater is set in advance for K based on energy lost when the hydraulic oil passes through the swing structure-operating control valve 6. Specifically, the value is energy of the hydraulic oil entering the swing structure-operating control valve 6 (a time-integrated value of pressure×flow rate) divided by energy of the hydraulic oil generated by the swing hydraulic motor (a time-integrated value of torque×angular velocity).

For example, if the swing structure-operating control valve 6 has an efficiency (=(energy of hydraulic oil coming out)÷(energy of hydraulic oil entering) of 0.8 and the swing hydraulic motor 8 has an efficiency (=(rotational energy generated)÷(energy of hydraulic oil entering) of 0.9, the reduction rate K is calculated as 1=(0.8×0.9)≈1.39 and this value of 1.39 is set.

If a gear is disposed between the swing electric motor 13 and the swing hydraulic motor 8 and part of energy output by the swing electric motor 13 is lost by the gear, the reduction rate K is made smaller by the loss.

If, for example, the swing structure-operating control valve 6 has an efficiency of 0.8, the swing hydraulic motor 8 has an efficiency of 0.9, and the gear of the swing electric motor 13 has an efficiency of 0.9, the reduction rate K is calculated as 0.9÷(0.8×0.9)=1.25 and this value of 1.25 is set.

It is noted that the value of the energy of the hydraulic oil entering the swing structure-operating control valve 6 divided by the energy generated by the swing hydraulic motor 8 tends to be greater at smaller operating amounts. The reduction rate K may therefore be controlled to be greater when the operating amount is small.

Additionally, the value of the energy of the hydraulic oil entering the swing structure-operating control valve 6 divided by the energy generated by the swing hydraulic motor 8 tends to be greater when pressure is relieved with a relief valve not shown on a meter-in side of the swing hydraulic motor 8. The reduction rate K may be controlled to be made greater when the meter-in pressure of the swing hydraulic motor 8 exceeds a predetermined threshold value.

In addition, the electric motor is generally faster in responding to a request to increase or decrease its output than the hydraulic pump. Thus, the output of the main pump 3 cannot be increased or decreased in response to a sharp increase or decrease in the output of the swing electric motor 13. The swing electric motor 13 may therefore be controlled so as to be retarded in increasing or decreasing its output for a response lag in the output of the main pump 3.

The foregoing arrangement makes energy supplied to the swing structure in the case "with additional energy" and energy supplied to the swing structure in the case "without additional energy" equal to each other and the same operability can be maintained regardless of whether or not the additional energy is available. In addition, in the case "with additional energy", energy generated by the main pump 3 is reduced to thereby reduce load on the engine 1 as the driving source, which allows the fuel consumption of the engine 1 to be reduced.

As such, when the swing operation is performed with sufficient electric power stored in the electric energy storage device 10 as the energy storage means, a greater fuel reduction effect can be obtained than in the boom raising operation.

The construction machinery according to the second embodiment of the present invention described above can achieve the same effect as that achieved by the construction machinery according to the first embodiment of the present invention described earlier.

Generally speaking, energy generated by the electric motor can be controlled with higher accuracy than energy generated by the hydraulic pump, which ensures that operability in the swing operation is not considerably impaired.

The second embodiment has been described for a case in which the boom cylinder 7 and the swing hydraulic motor 8 are actuators. This is, however, not the only possible arrangement. Alternatively, a different actuator may be used in place of the boom cylinder 7 and the actuator to which additional energy is supplied by the electric motor may be applied to operations other than the swing operation.

DESCRIPTION OF REFERENCE NUMERALS

1 Engine
2 Fuel tank
3 Main pump
4 Control valve (flow control means)
5 Boom-operating control valve
6 Swing structure-operating control valve
7 Boom cylinder
8 Swing hydraulic motor
9 Generator-motor (prime mover)
10 Electric energy storage device (energy storage means)
11 Hydraulic pump motor
12 Changeover valve
13 Swing electric motor (prime mover)
14 Relief valve
15 Relief valve
16 Hydraulic oil tank
20 Controller (control means)
30 Main line
36 First sub-line
37 Second sub-line
38 Third sub-line

The invention claimed is:

1. Construction machinery including:

at least two actuators including a cylinder and a hydraulic motor;

a main pump that discharges hydraulic oil for driving the actuators, lines for connecting the main pump and each of the actuators;

flow control valves disposed in the lines, the flow control valves including a control valve for operating the cylinder and a control valve for operating the hydraulic motor;

a hydraulic pump motor that adds hydraulic oil to the lines;

sub-lines for connecting the hydraulic pump motor and the lines; and a controller that reduces a discharge flow rate of the main pump when the hydraulic oil from the hydraulic pump motor is added to any of the lines through any of the sub-lines, wherein one of the sub-lines is connected to a line between the main pump and the control valve for operating the cylinder among the lines, and remaining sub-lines of the sub-lines are connected to lines between the control valve for operating the hydraulic motor and the hydraulic motor among the lines, wherein a changeover valve is disposed in each of the sub-lines, wherein the controller reduces the discharge flow rate of the main pump and controls the changeover valves such that the hydraulic oil from the hydraulic pump motor is supplied to the line between the main pump and the control valve for operating the cylinder when the cylinder is operated by an operation signal from an operating lever, and reduces the discharge flow rate of the main pump at a larger reduction rate than when the cylinder is operated and controls the changeover valves such that the hydraulic oil from the hydraulic pump motor is supplied to one of the lines between the control valve for operating the hydraulic motor and the hydraulic motor when the hydraulic motor is operated by an operation signal from the operating lever.

* * * * *